United States Patent [19]

Bonar, II

[11] 4,282,717

[45] Aug. 11, 1981

[54] OIL SEPARATOR AND HEAT EXCHANGER FOR VAPOR COMPRESSION REFRIGERATION SYSTEM

[76] Inventor: Henry B. Bonar, II, 4939 Morven Rd., Jacksonville, Fla. 32210

[21] Appl. No.: 95,499

[22] Filed: Nov. 19, 1979

[51] Int. Cl.[3] ..... F25B 43/02

[52] U.S. Cl. ..... 62/84; 62/113; 62/473; 62/513

[58] Field of Search ..... 62/84, 468, 470, 473, 62/113, 513

[56] References Cited

U.S. PATENT DOCUMENTS

| | | | |
|---|---|---|---|
| 320,307 | 6/1885 | Suckert | 62/473 |
| 1,835,081 | 12/1931 | Pollard | 62/473 |
| 2,512,758 | 6/1950 | Winkler | 62/473 |
| 2,618,132 | 11/1952 | Pottenger, Jr. | 62/470 |
| 2,749,723 | 6/1956 | Webber | 62/470 |
| 3,021,689 | 2/1962 | Miller | 62/473 |
| 3,283,532 | 11/1966 | Kocher | 62/84 |

FOREIGN PATENT DOCUMENTS

| | | | |
|---|---|---|---|
| 2380481 | 8/1973 | Fed. Rep. of Germany | 62/470 |
| 2629573 | 3/1977 | Fed. Rep. of Germany | 62/468 |
| 30704 | 9/1924 | France | 62/473 |

*Primary Examiner*—Ronald C. Capossela
*Attorney, Agent, or Firm*—Arthur G. Yeager

[57] ABSTRACT

A method and apparatus for removing oil from the refrigerant in a vapor compression refrigeration system comprising a compressor, a condenser, an evaporator, and a vertical oil separation and heat exchange column into which hot compressed refrigerant vapors containing entrained oil are introduced to flow upwardly countercurrently with cool refrigerant liquid introduced to flow downwardly in direct intimate mutual contact, said column comprising (1) an inlet vapor distributor to disperse vapors throughout the cross section of the column to flow upwardly around baffles and to be removed in the top of the column and be directed to said condenser, (2) an inlet liquid line comprising an hydraulic leg wherein the liquid is of sufficient pressure to resist the pressure of said vapors, (3) a means for distributing said liquid throughout the cross section of said column to fall by gravity to a pool of liquid in the bottom of the column, (4) an outlet from said pool of liquid directed to said evaporator and (5) an outlet for removing oil separated from said refrigerant liquid.

13 Claims, 3 Drawing Figures

OIL SEPARATOR AND HEAT EXCHANGER FOR VAPOR COMPRESSION REFRIGERATION SYSTEM

BACKGROUND OF THE INVENTION

Vapor compression refrigeration systems have been well known for many years. They involve the compression of vapors followed by cooling of those vapors to cause the vapors to liquefy. The refrigerant liquid is then evaporated by passing it through coils which absorb heat from the atmosphere surrounding the coils and thus produce refrigeration at that point. The evaporated liquid becomes the vapor inlet to the compressor to complete the cycle of the refrigerant. There have been attempts in the past to produce more efficient systems by conserving the heat in the compressed vapors and by saturating the vapors in the inlet to the compressor. These attempts have been partially successful but have not utilized the energy of the system as completely as possible.

The compressor of the system has normally been one which requires lubricating oil to function properly, and a portion of that lubricating oil inevitably finds its way through less than perfect sealing devices into the refrigerant. Although the presence of some oil in the system is not considered to be detrimental it can be understood that in such a system oil accumulates and eventually must be removed.

It is an object of the present invention to provide a system wherein oil is continuously separated from the refrigerant in a process involving a highly efficient heat exchange operation. It is another object of this invention to provide efficient heat exchange by direct contact between the refrigerant liquid and hot refrigerant gases. It is still another object of this invention to provide an apparatus for accomplishing the oil separation and the heat exchange. Still other objects will appear from the more detail description of this invention which follows.

BRIEF SUMMARY OF THE INVENTION

This invention includes a method of removing oil from refrigerant in refrigeration cycles involving the compression of refrigerant vapor, condensing the compressed vapor to a liquid, and evaporating the liquid to a vapor; the method comprising passing hot compressed refrigerant vapors containing entrained droplets of oil in countercurrent heat exchange relationship with cool liquid refrigerant in a confined space wherein streams of liquid refrigerant fall downwardly by gravity in direct contact with upwardly flowing hot compressed refrigerant vapors, said vapors being subjected, while in said confined space, to sudden changes in flow direction and to sudden changes in velocity whereby entrained droplets of oil separate from the vapors and fall by gravity into the bottom of the confined space containing a pool of refrigerant liquid, and separating said oil from said pool of refrigerant liquid.

Another portion of this invention involves a vapor compression refrigeration system which comprises a compressor, a condenser, an evaporator, and a vertical oil separation and heat exchange column into which hot compressed refrigerant vapors containing entrained oil are introduced to flow upwardly and countercurrently with cool refrigerant liquid introduced to flow downwardly in direct intimate mutual contact, said column comprising (a) an inlet vapor distributor to disperse vapors throughout the cross section of the column to flow upwardly around baffles and to be removed in the top of the column and be directed to said condenser (b) an inlet liquid line comprising an hydraulic leg wherein the liquid is under sufficient pressure to resist the pressure of said vapors, (c) a means for distributing liquid throughout the cross section of said column to fall by gravity to a pool of liquid in the bottom of the column, (d) an outlet from said pool of liquid directed to said evaporator, and (e) an outlet for removing oil separated from said refrigerant liquid.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference of the following description taken inconnection with the accompanying drawings in which:

DETAILED DESCRIPTION OF THE INVENTION

Figure 1:
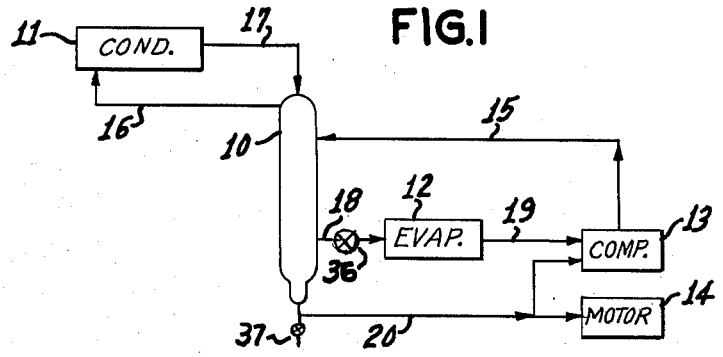
FIG. 1 is a schematic illustration of a vapor compression refrigeration system incorporating the oil separation and heat exchange component of this invention.

In FIG. 1 there are shown the normal components of a vapor compression refrigeration system into which has been incorporated the oil separator and heat exchanger of this invention. Column 10 is the oil separator and heat exchanger of this invention receiving hot compressed refrigerant vapors in line 15 and discharging those vapors, after removing some of the sensible heat therefrom, through line 16 to condenser 11. Condenser 11 transforms refrigerant vapors received from line 16 to refrigerant liquid and passes it through line 17 into the top of column 10. After the refrigerant liquid absorbs some sensible heat in its passage through column 10, it exits through line 18 and is conducted through expansion device 36 into evaporator 12 where it is transformed back into a vapor and is conducted through line 19 to the inlet of compressor 13. Compressor 13 raises the pressure and temperature of vapors and returns them to column 10 through line 15 as mentioned above completing the cycle of the refrigerant. Compressor 13 requires oil for lubrication of its moving parts and minute amounts of the oil leak past the seals separating the compressed vapors from the oil passages. These minute quantities of oil become entrained in the hot refrigerant vapors and pass through line 15 into column 10. In the operation of column 10 the entrained oil is separated from the refrigerant and accumulates in the bottom of column 10 and removed through valve 37 or passed through line 20 to be returned with or without further purification, for use as a lubricant motor 14 or compressor 13 which is driven by motor 14.

The refrigerant employed in this invention is any of several normally used in vapor compression systems, e.g. ammonia, halocarbons (Freon), sulfur dioxide, carbon dioxide, butane, etc. The preferred refrigerants are ammonia and halocarbons.

Figure 2:
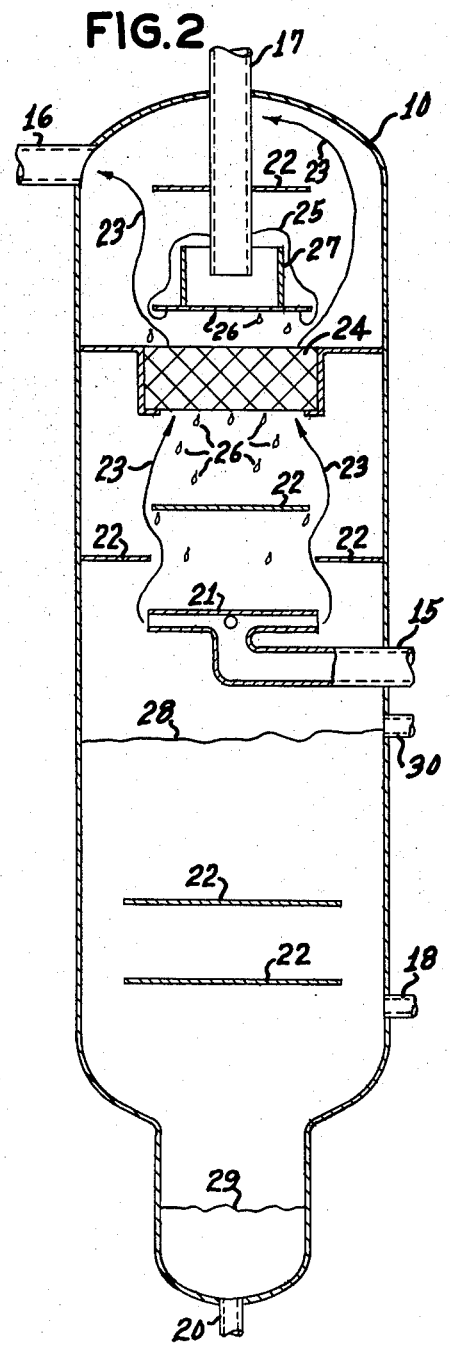
FIG. 2 is a vertical cross section of an oil separator and heat exchanger of this invention.
Figure 3:
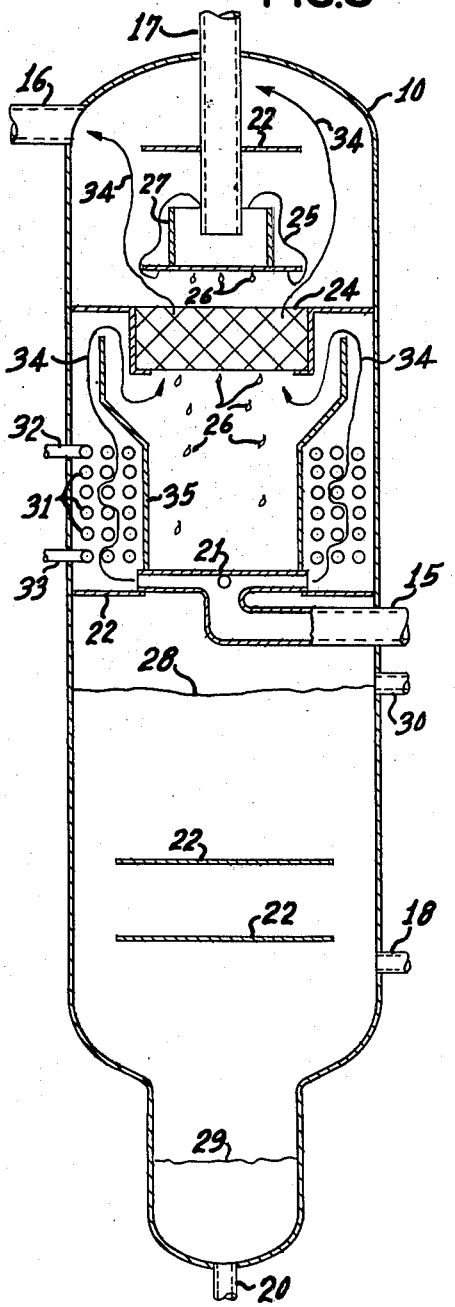
FIG. 3 is a vertical cross section illustrating an oil separator and heat exchanger of this invention which includes an additional heat exchange means not incorporated in the apparatus of FIG. 2.

By reference to FIGS. 2 and 3 the operation of the oil separation and heat exchange means of this invention can be fully appreciated. With particular reference to FIG. 2 there may be seen the basic operation of column 10 which provides the oil separation and heat exchange of this invention. Hot refrigerant vapors enter column 10 through line 15 and are conducted to a distributor 21 which disperses the vapors throughout the cross section of column 10 and permits them to rise upwardly toward the top of the column. Distributor 21 is shown here as a plurality of conduits leading from a central inlet hub to a plurality of outlets near the vertical wall of column 10. These conduits are in the general configuation of the spokes of a wheel in this illustration. It is to be understood however that any type of distributor which serves to disperse the vapors throughout the cross section of column 10 and direct them upwardly is suitable for this purpose.

Vapors leaving distributor 21 passed upwardly around baffles 22 undergoing sudden changes in direction as shown by arrows 23. The vapors also undergo sudden changes in velocity when they pass through portions of the column where the cross sectional area available to the moving vapors increases or decreases suddenly. As the vapors move upwardly along the general path 23 they come in contact with droplets of refrigerant liquid 26 falling downwardly by gravity like rain. Since the liquid droplets 26 are cool and the rising vapors are hot there is a natural heat exchange between the liquid and vapor which tends to heat the liquid and vapor which tends to heat the liquid and cool the vapor simultaneously.

In order to provide more intimate contact between the liquid refrigerant flowing downwardly and the hot compressed vapors flowing upwardly, and also to provide a means for reducing the size of the droplets of liquid refrigerant there is provided a mesh basket 24 serving as a baffle and as a means for intimately mixing the vapors and liquids. Mesh baskets 24 may be any of a variety known materials used for this purpose. For example, mesh basket 24 may be the series of perforated plates, metal or ceramic packing as used in packed columns for liquid-vapor contact, a basket filled with metal wire (such as steel wool) or any of variety of other known means for providing intimate contact between liquid and vapors flowing countercurrently with respect to each other.

Vapors rising from mesh basket 24 pass by means of paths 23 through the top of column 10 and into line 16 leading to the condenser wherein the compressed gases, which have been cooled somewhat by passage through column 10, are further cooled to cause their condensation into a liquid. Liquid refrigerant from the condenser is introduced into column 10 through line 17 leading into overflow container 27 which is open at the top so that the liquid will overflow at 25 and flow downwardly over the outside of container 27 to its base and thereafter fall in streams or droplets onto the top of mesh basket 24. The liquid in line 17 must be under sufficient pressure to resist the pressure of the refrigerant vapors, which may be at a pressure of 100–200 psig. If the vapors are not counteracted by an equivalent or greater pressure of the liquid in line 17, those vapors would cause a back flow in line 17 and the entire system would become inoperative. Pressure on the liquid in line 17 may be produced by any suitable means, such as a pump in line 17, or, if the conditions permit it, by having sufficient vertical height in line 17 to produce all or part of that pressure as a head of liquid.

Liquid overflowing from container 27 falls into mesh basket 24 and is broken up into minute streams and droplets which fall from the bottom of mesh basket 24 onto the first of a series of baffles 22 and thence downwardly in the column eventually reaching a pool of liquid, the top level of which is shown at 28. Liquid refrigerant is removed through line 18 and expanded into evaporator to produce its refrigeration effect.

Oil which is entrained as droplets in the hot refrigerant gases entering through line 15 is heavier than the vapors which carry it, and as those vapors are subjected to sudden changes in direction and velocity by passing around the various baffles 22 and through mesh basket 24, the oil droplets are separated from the vapor and combine with other droplets to form large drops that fall by gravity into the liquid pool at the bottom of the column. The cooling of the hot refrigerant vapors by contact with the cool refrigerant liquid also helps to separate the oil from the vapors by causing the viscosity of the oil to increase. If the oil has a greater density than the refrigerant e.g. when the refrigerant is ammonia the oil will accumulate in the bottom of the column as shown at level 29 in a small receiver with outlet 20 leading directly or through a receiver to the motor or compressor. If the oil has a smaller density than the refrigerant, e.g. when the refrigerant is a halocarbon, the oil may separate as a layer on the top of the refrigerant liquid and can then be removed through line 30. The heat exchange capabilities of column 10 are very good because of the direct contact between the downflowing droplets of cool liquid and the upflowing hot vapors. This heat exchange is desirable since the hot compressed vapors must be cooled in order to produce the refrigerant liquid.

In FIG. 3 there is a similar system to that shown in FIG. 2 except that a supplemental heat exchanger is employed to recover and conserve more energy than that shown in the system of FIG. 2. In this embodiment a coil is positioned immediately above distributor 21 and the hot compressed vapors leaving distributor 21 are directed upwardly around the outside of the coil while water or other heat exchange liquid is circulated through the interior of the coil. In this instance water or other heat exchange liquid is introduced in line 32 circulates around through the various cycles 31 of the coil and removed through line 33. The heat energy picked up by the liquid in the coil is available for use elsewhere. For example, if the heat exchange liquid in the coil is water, it could be employed as the inlet to a hot water heater or a steam generator used elsewhere in the plant employing this refrigeration system.

In order for the flow of hot refrigerant gases to be confined to the coil, column 10 in FIG. 3 is constructed with a vertical cylindrical baffle 35 which serves to direct the hot vapors in the general path shown as 34 through the coil and thence in a reverse bend downwardly and upwardly through mesh basket 24 as described previously. All of the remaining parts of the embodiment shown in FIG. 3 are identical to and operate as described with respect to FIG. 2.

I claim:

1. A method of removing oil from the refrigerant in refrigeration system including a motor driving a compressor for compressing the refrigerant vapor, a condenser for condensing the compressed vapor to a liquid, and an expansion device and an evaporator for expanding and evaporating the liquid to a vapor; the method comprising introducing hot compressed refrigerant vapors having a predetermined pressure and containing entrained droplets of oil into a confined space, introducing cool liquid refrigerant under sufficient pressure to overcome the pressure of the hot compressed vapors into the confined space spacedly above the introduction of the hot compressed refrigerant vapors such that droplets of the liquid refrigerant fall downwardly by gravity in direct contact with the upwardly flowing hot compressed refrigerant vapors to effect a countercurrent heat exchange therebetween, subjecting the vapors while in said confined space to sudden changes in flow direction and to sudden changes in velocity to effect separation of the entrained oil droplets of oil from the vapors with the oil droplets falling by gravity into the bottom of the confined space into a pool of refrigerant liquid, separating the oil from the pool of refrigerant liquid, extracting the separated oil to lubricate the motor and compressor, and extracting the refrigerant liquid from the pool to the expansion device and the evaporator.

2. The method of claim 1 wherein said hot compressed refrigerant vapaors are passed in indirect heat exchange relationship with cool water prior to the direct contact with the cool liquid refrigerant.

3. The method of claim 1 wherein said refrigerant is ammonia or a halocarbon.

4. The method of claim 1 wherein the liquid refrigerant is introduced into the confined space by means of a flowing stream of the liquid refrigerant, the sufficient pressure to overcome the pressure of the hot refrigerant vapors in the confined space being provided by a liquid column of sufficient height above the point of introduction of the liquid refrigerant.

5. A compression refrigeration system which comprises a motor driving a compressor for compressing refrigerant vapor, a condenser for condensing the compressed vapor to a liquid, an expansion device and an evaporator for expanding and evaporating the liquid to a vapor, and a vertical oil separation and heat exchange column into which hot compressed refrigerant vapors containing entrained oil are introduced to flow upwardly and countercurrently with cool refrigerant liquid introduced to flow downwardly in direct intimate mutual contact, said column comprising an inlet vapor distributor to disperse vapors substantially throughout the cross section of the column, spaced baffles located above said distributor, a vapor outlet adjacent the top of the column communicating with said condenser, an inlet liquid including a hydraulic leg wherein the liquid is under sufficient pressure to overcome the pressure of said vapors, means connected to said hydraulic leg for distributing said liquid generally medially of said column to fall by gravity to a pool of said liquid in the bottom of the column, an outlet from said pool of liquid communicating with said expansion device and evaporator, and an outlet for removing oil separated from said refrigerant liquid communicating with said compressor and motor.

6. The system of claim 5 wherein the interior of said column contains a plurality of fixed baffles to deflect the flow of vapors and the flow of liquid into nonlinear paths.

7. The system of claim 6 wherein said fixed baffles comprise a plurality of discs and annular rings spaced vertically and in alternate relationship to each other.

8. The system of claim 5 wherein said column contains a coil through which circulates a cool heat exchange liquid for indirect heat exchange with said incoming hot compressed refrigerant vapors prior to said direct contact with said cool refrigerant liquid.

9. The system of claim 8 wherein said coil is disposed in an annular space within said column and outwardly of a vertical generally cylindrical baffle located above and contiguous to said vapor distributor and concentric to said column, whereby said inlet vapors are directed upwardly around said vertical baffle into contact with said coil before contact with said cool refrigerant liquid.

10. The system of claim 5 wherein said column contains a porous mesh flow mixer through which all of said liquid must flow downwardly and all of said vapors must flow upwardly, said mixer providing tortuous paths for said liquid and said vapors to have intimate countercurrent contact therebetween.

11. The system of claim 5 wherein said column includes an oil receiver at its lower extremity in the form of a downwardly projecting portion of smaller transverse cross section than that of said column.

12. The system of claim 5 wherein said refrigerant liquid is introduced into the upper extremity of said column through a vertical conduit open at its lower end which is disposed in a small container open at its upper end, the lower end of said conduit being at an elevation below that of the upper end of said container.

13. The system of claim 12 wherein said container comprises a generally cylindrical vertical wall and a horizontal plate attached to the bottom of said wall and extending outwardly thereof to form a flange.

* * * * *